US010999673B2

(12) United States Patent
Cho et al.

(10) Patent No.: US 10,999,673 B2
(45) Date of Patent: May 4, 2021

(54) THIN SPEAKER WITH CURVED OR ANGLED STRUCTURE

(71) Applicant: Resonado, Inc., South Bend, IN (US)

(72) Inventors: Leeg Hyun Cho, Yongin-si (KR); Youngil Cho, Chicago, IL (US); Christian Femrite, Westminster, CO (US)

(73) Assignee: Resonado, Inc., South Bend, IN (US)

( * ) Notice: Subject to any disclaimer, the term of this patent is extended or adjusted under 35 U.S.C. 154(b) by 0 days.

(21) Appl. No.: 16/672,320

(22) Filed: Nov. 1, 2019

(65) Prior Publication Data

US 2020/0275213 A1 Aug. 27, 2020

Related U.S. Application Data

(60) Provisional application No. 62/809,866, filed on Feb. 25, 2019.

(51) Int. Cl.

| | |
|---|---|
| ***H04R 25/00*** | (2006.01) |
| ***H04R 1/24*** | (2006.01) |
| ***H04R 7/16*** | (2006.01) |
| ***H04R 9/02*** | (2006.01) |
| ***H04R 9/04*** | (2006.01) |
| ***H04R 9/06*** | (2006.01) |
| ***H04R 3/00*** | (2006.01) |
| ***H04R 1/02*** | (2006.01) |
| ***H04R 7/12*** | (2006.01) |

(52) U.S. Cl.

CPC ..... *H04R 1/24* (2013.01); *H04R 1/02* (2013.01); *H04R 3/00* (2013.01); *H04R 7/127* (2013.01); *H04R 7/16* (2013.01); *H04R 9/025* (2013.01); *H04R 9/04* (2013.01); *H04R 9/045* (2013.01); *H04R 9/06* (2013.01); *H04R 2400/11* (2013.01)

(58) Field of Classification Search

CPC ..... H04R 1/02; H04R 2400/11; H04R 7/127; H04R 9/045; H04R 9/06; H04R 1/24; H04R 1/323; H04R 1/345; H04R 1/403; H04R 3/00; H04R 7/16; H04R 9/025; H04R 9/04; H04R 9/047; H04R 9/063

USPC ..... 381/396

See application file for complete search history.

(56) References Cited

U.S. PATENT DOCUMENTS

| | | | | |
|---|---|---|---|---|
| 7,480,392 | B2 | 1/2009 | Shin et al. | |
| 7,502,486 | B2 | 3/2009 | Shin et al. | |
| 2004/0008859 | A1 * | 1/2004 | Zhao | H04R 9/063 381/401 |

(Continued)

FOREIGN PATENT DOCUMENTS

| | | | |
|---|---|---|---|
| KR | 101425912 | B1 | 8/2014 |
| WO | 2018 096761 | A1 | 5/2018 |

*Primary Examiner* — Phylesha Dabney

(74) *Attorney, Agent, or Firm* — DLA Piper LLP (US)

(57) ABSTRACT

Disclosed are numerous embodiments of speakers of non-conventional shape. In one set of embodiments, each speaker comprises a pair of curved magnets and a curved voice coil plate located between the magnets and parallel to the magnets. In another set of embodiments, each speaker comprises two or more segments attached at an angle to one another, where each segment comprises a pair of bar magnets and a voice coil plate located between the magnets. Optionally, the magnets and voice coil plate can be curved or angled in a third-dimension as well. The embodiments allow for a speaker to be built of almost any shape.

19 Claims, 16 Drawing Sheets

(56) References Cited

U.S. PATENT DOCUMENTS

| | | | |
|---|---|---|---|
| 2011/0044489 | A1 | 2/2011 | Saiki et al. |
| 2014/0161303 | A1 | 6/2014 | Kim |
| 2016/0205479 | A1 | 7/2016 | Tomar et al. |
| 2016/0373862 | A1 | 12/2016 | Yoon et al. |

* cited by examiner

THIN SPEAKER WITH CURVED OR ANGLED STRUCTURE

PRIORITY CLAIM

This application claims priority to U.S. Provisional Patent Application No. 62/809,866, filed on Feb. 25, 2019, and titled, "A Speaker Capable of Producing a Multi-Range and Bidirectional Sound Using Bar Magnets," which is incorporated by reference herein.

TECHNICAL FIELD

Disclosed are numerous embodiments of speakers with a curved or angled frame. In some embodiments, the speakers are capable of playing bidirectional sound.

BACKGROUND OF THE INVENTION

A schematic illustration of commonly-used, prior art cone-type speaker 100 is shown in FIG. 1. Cone-type speaker 100 usually has a cylindrical shape and uses a cylindrical permanent magnet 10. Cone-type speaker 100 also comprises voice coil 11, diaphragm 12, basket 13, and damper 14. Notably, because diaphragm 12 is cone-shaped, it has a significant height, which sets a limit on how thin the overall speaker structure can be. In addition, T-yoke 15 has a significant height and also sets a limit on how thin the overall speaker structure can be.

This type of speaker contains a diaphragm whose outer boundary forms a circle when viewed from the top. A speaker with a circular shape often is not suitable for the structure in which the speaker is being placed, which results in an overall design that is inefficient.

What is needed is a speaker whose overall shape can be designed to conform to whatever space is available in the structure in which the speaker is to be placed.

SUMMARY OF THE INVENTION

Disclosed are numerous embodiments of speakers of non-conventional shape. In one set of embodiments, each speaker comprises a pair of curved magnets and a curved voice coil plate located between the magnets and parallel to the magnets. In another set of embodiments, each speaker comprises two or more segments attached at an angle to one another, where each segment comprises a pair of bar magnets and a voice coil plate located between the magnets. Optionally, the magnets and voice coil plate can be curved or angled in a third-dimension as well. The embodiments allow for a speaker to be built of almost any shape.

DETAILED DESCRIPTION OF THE PREFERRED EMBODIMENT

Features and advantages of the present invention described above will become apparent from the following descriptions in conjunction with the accompanying drawings. According to the descriptions, one with the proper technical expertise will be able to execute the technical idea illustrated in this present invention in the relevant industry. Since this invention can have a variety of different applications and may take different forms and shapes, only specific examples are illustrated through Figures, and the detailed descriptions are found in the main text. However, this is by no means to restrict the present invention to the particular form disclosed; its derivations, equivalents, and substitutes must be understood as embracing all included in the scope of the present invention. The terms used herein are merely used to describe particular examples and are not intended to limit the present invention.

Figure 1:
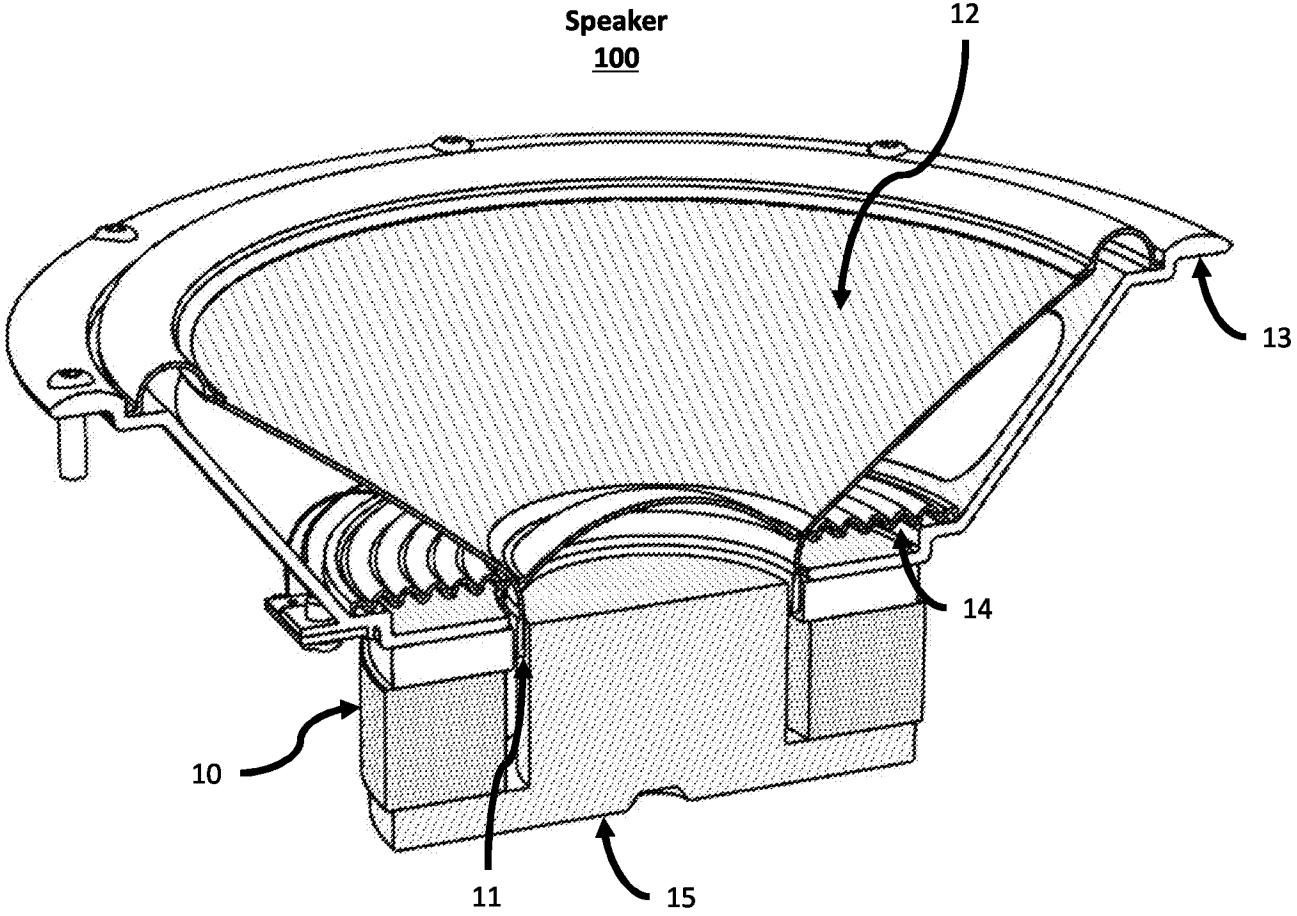
FIGURE 1 (PRIOR ART)
FIG. 1 depicts a prior art speaker with a cone-shaped structure.
Figure 2A:
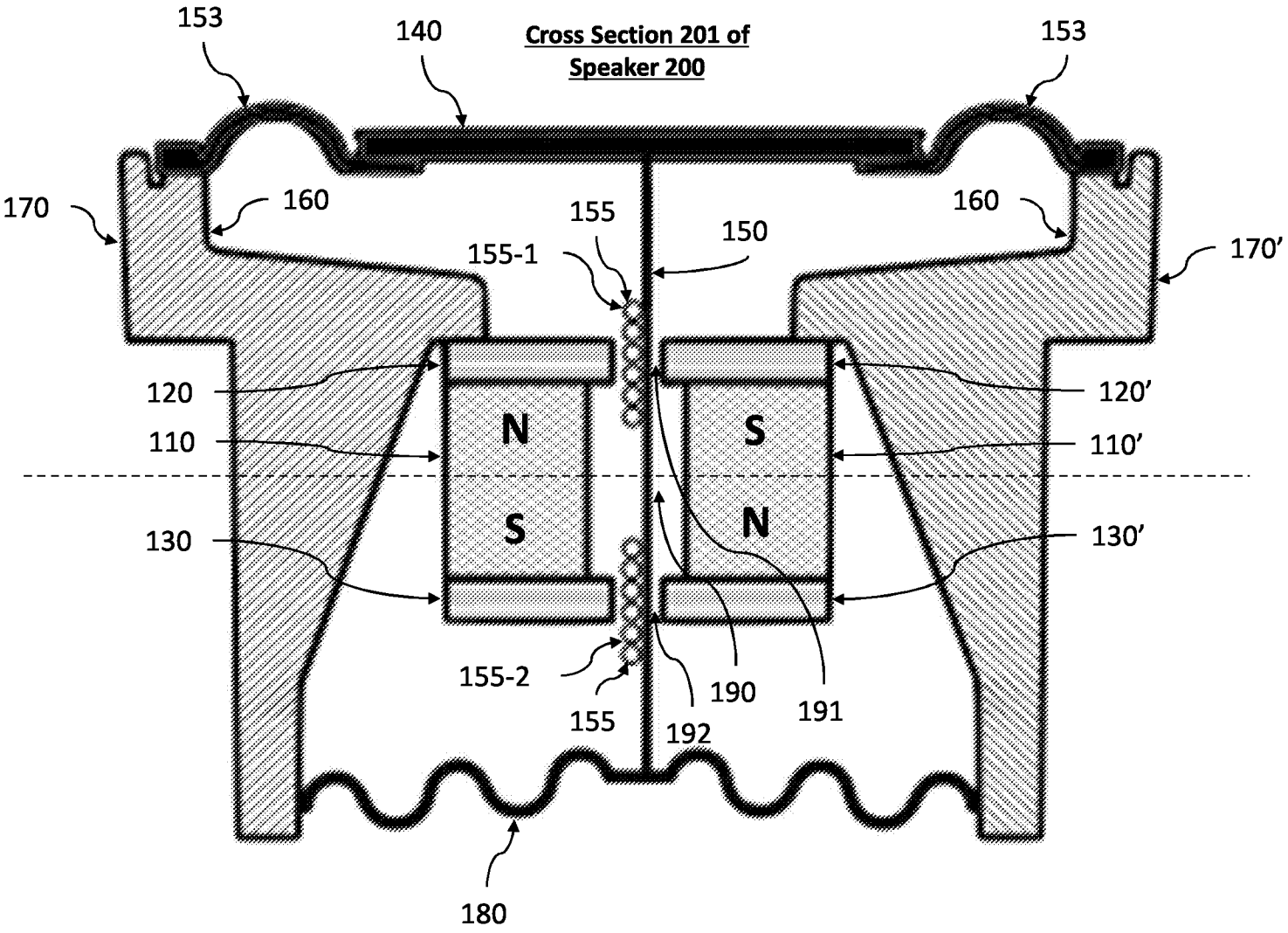
FIG. 2*a* depicts a cross-section of an embodiment of a speaker comprising a pair of magnets and a voice coil plate that plays sound in one direction.

FIG. 2*a* depicts cross-section 201 of speaker 200. Speaker 200 comprises magnets 110 and 110', upper magnetic yokes 120 and 120', lower magnetic yokes 130 and 130', diaphragm 140, voice coil plate 150, coil 155, and damper 180. Speaker 200 further comprises speaker frame 160, which here comprises wall 170 and wall 170'. In this particular portion of speaker 200, wall 170 and 170' are substantially parallel to one another. Magnets 110 and 110' are positioned a predetermined distance apart such that the opposite polarities are facing each other. In other words, the north pole of magnet 110 is positioned so that it is across from the south pole of magnet 110', and the south pole of magnet 110 is positioned so that it is across from the north pole of magnet 110'. Coil 155 further comprises top section 155-1 and bottom section 155-2. On the end proximate to segment 155-1, voice coil plate 150 is secured to diaphragm 140, and on the other end proximate to segment 155-2, voice coil plate 150 is secured to damper 180. Damper 180 is secured to speaker frame 160. Diaphragm 140 is connected to speaker frame 160 through connector 153, which can be made from a flexible material such as rubber.

Figure 2B:
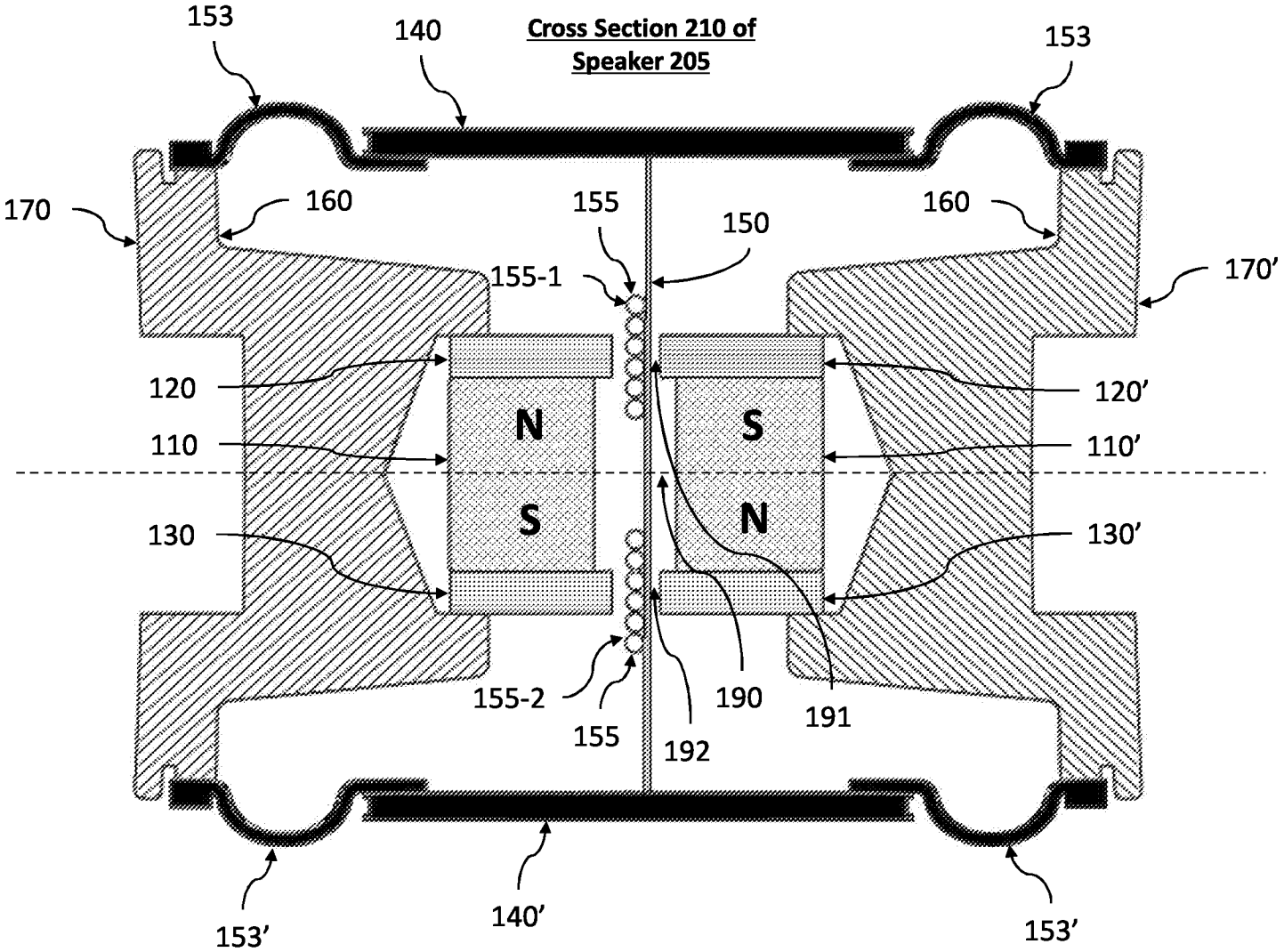
FIG. 2*b* depicts a cross-section of an embodiment of a speaker comprising a pair of magnets and a voice coil plate that plays sound in two directions.

FIG. 2*b* depicts cross-section 210 of speaker 205. Speaker 205 comprises magnets 110 and 110', upper magnetic yokes 120 and 120', lower magnetic yokes 130 and 130', diaphragm 140, diaphragm 140', voice coil plate 150, and coil 155, as in FIG. 2*a*. Speaker 205 further comprises speaker frame 160, which here comprises wall 170 and wall 170', as in FIG. 2*a*. In this particular portion of speaker 205, wall 170 and 170' are substantially parallel to one another. Magnets 110 and 110' are positioned as in FIG. 2*a*. Coil 155 further comprises top section 155-1 and bottom section 155-2, as in FIG. 2*a*. On the end proximate to segment 155-1, voice coil plate 150 is secured to diaphragm 140, and on the other end proximate to segment 155-2, voice coil plate 150 is secured to diaphragm 140'. Diaphragm 140 and 140' are connected to speaker frame 160 through connectors 153 and 153', respectively, which can be made from a flexible material such as rubber. Optionally, either diaphragm 140 or 140' can be replaced with a damper, resulting in a speaker similar to the speaker of FIG. 2*a*.

With respect to both FIG. 2*a* and FIG. 2*b*, upper magnetic yokes 120 and 120' are attached to the upper part of magnets 110 and 110', and lower magnetic yokes 130 and 130' are attached to the lower part of magnets 110 and 110'. In both FIG. 2*a* and FIG. 2*b*, upper magnetic yokes 120 and 120' and lower magnetic yokes 130 and 130' contain and direct the magnetic field in the area between the magnets where voice coil plate 155 resides. In both FIG. 2*a* and FIG. 2*b*, upper magnetic yokes 120 and 120' and lower magnetic yokes 130 and 130' optionally may extend beyond magnets 110 and 110' into the magnetic gap. This can be seen in the embodiment shown in FIG. 2*a* and in FIG. 2*b* by gap 191 between magnetic yokes 120 and 120' and by gap 192 between magnetic yokes 130 and 130', which are both smaller than the gap 190 between the magnets 110 and 110'. Optionally, magnetic yokes 120 and 120' may comprise the same magnetic yoke; also, optionally, magnetic yokes 130 and 130' may comprise the same magnetic yoke.

With respect to both FIG. 2*a* and FIG. 2*b*, voice coil plate 150 should be positioned in a planar form in the spacing between magnets 110 and 110'. Voice coil 155 can be fastened to one side of voice coil plate 150 or on both sides. In FIG. 2*a*, diaphragm 140 will be vibrated at a specific frequency range by the magnetic field created by the pair of magnets 110 and 110' and the electric current flowing in the voice coil 155. In FIG. 2*b*, diaphragms 140 and 140' each will be vibrated at a specific frequency range by the magnetic field created by the pair of magnets 110 and 110' and the electric current flowing in the voice coil 155.

During operation, coil 155 receives an electrical audio signal from signal source 250 (not shown). A magnetic field is induced by magnets 110 and 110', generally in the direction from the north poles (N) to the south poles (S). During the first half of the signal cycle (defined as the "positive half-cycle"), current flows through coil 155-1 "out of the page", and current flows through coil 155-2 "into the page". Lorentz forces are generated both by coil 155-1 interacting with the magnetic forces between top magnetic yokes 120 and 120' and by coil 155-2 interacting with the magnetic forces between bottom magnetic yokes 130 and 130', with the forces aligned in the same direction and pushing voice coil plate 150 upward, which pushes diaphragm 140 (and, in the case of FIG. 2*b*, diaphragm 140') upward according to the magnitude of the electrical signal from signal source 250 (not shown). During the second half of the signal cycle (defined as the "negative half-cycle"), current flows through coil 155-1 "into the page", and current flows through coil 155-2 "out of the page". Since the direction of the current is reversed, the Lorentz forces from the interaction with the magnetic field between 120, 120' and 130, 130', respectively, will align in the same direction to push voice coil plate 150 downward, which pushes diaphragm 140 (and, in the case of FIG. 2*b*, also diaphragm 140') downward according to the magnitude of the electrical signal from signal source 250 (not shown). Thus, the electric audio signal from signal source 250 is translated into kinetic energy to move diaphragm 140 (and, in the case of FIG. 2*b*, also diaphragm 140'), reproducing sound.

Cross-section 201 of speaker 200 and cross-section 205 of speaker 210 represent basic designs that can be used in speakers of various shapes. The speaker can be shaped into any conceivable three-dimensional contour. Multiple drivers with different voice coil plates, diaphragms, and magnets can be used. In one design approach, a speaker includes an additional driver at every juncture on the contour for which the speaker is required to bend along the third axis (the same axis that would require the coil plate to twist). Other variations of this embodiment that may also be useful may specify an overlap in usage between diaphragms, voice coil plates, coils, and/or magnets between multiple segments of the structure, as needed. In other words, components of the same type implemented in adjacent segments optionally may be combined into substantially the same piece of material to reduce part count, where applicable.

Figure 3A:
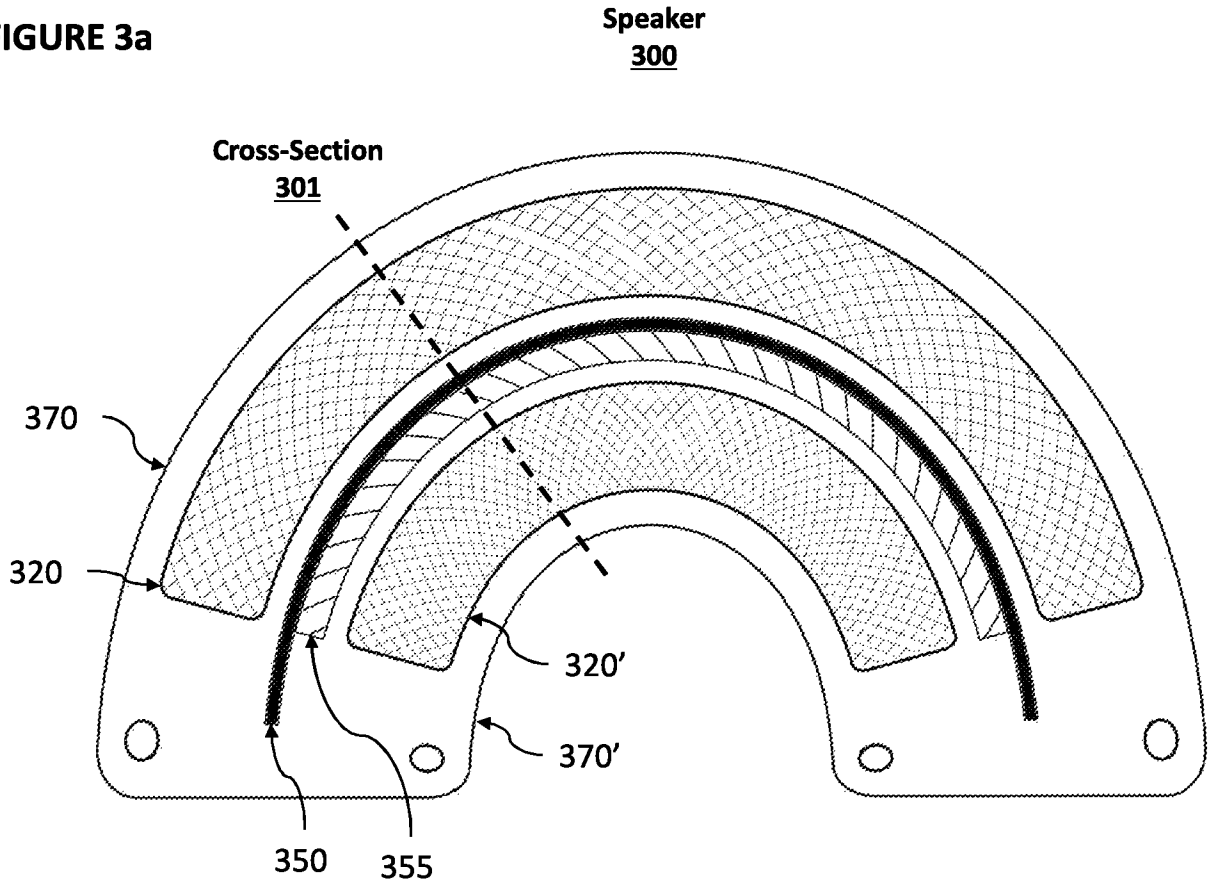
FIG. 3*a* depicts a cross-section of an embodiment of a speaker with a curved shape.

FIG. 3*a* depicts a cross-section top view of speaker 300, which has a curved shape in the form of a half-circle or half-ellipse. Speaker 300 can be built according to cross-section 201 shown in FIG. 2*a*, or according to cross-section 205 shown in FIG. 2*b*. An exemplary cross-section 301 is shown, which corresponds to cross-section 201 in FIG. 2*a* or to cross-section 205 in FIG. 2*b*, depending on if the design includes diaphragm 140' or damper 180, as appropriate.

FIG. 3*a* further shows speaker frame 360 which comprises speaker walls 370 and 370' (corresponding to speaker walls 170 and 170' in FIG. 2*a* and FIG. 2*b*), top magnetic yokes 320 and 320' (corresponding to top magnetic yokes 120 and 120' in FIG. 2*a* and FIG. 2*b*), voice coil plate 350 (corresponding to voice coil plate 150 in FIG. 2*a* and FIG. 2*b*), and coil 355 (corresponding to coil 155 in FIG. 2*a* and FIG. 2*b*).

Figure 3B:
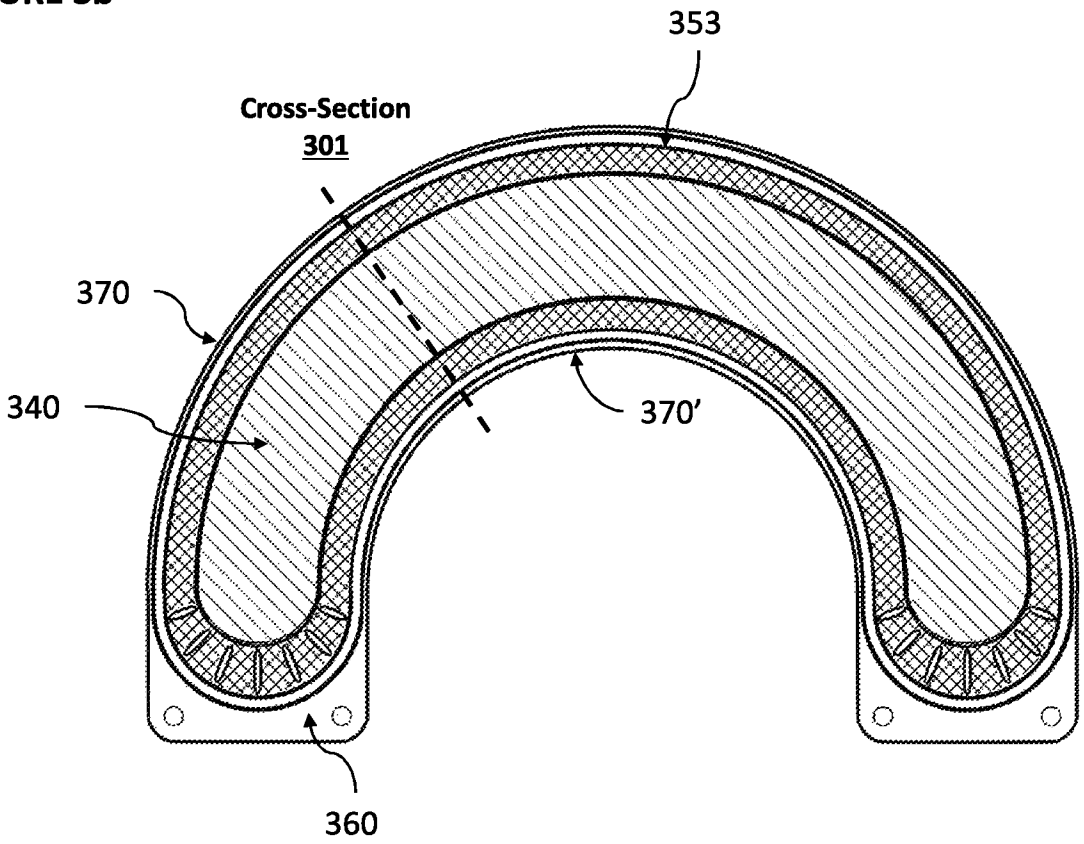
FIG. 3*b* depicts the top view of the embodiment of the speaker of FIG. 3*a*

FIG. 3*b* shows a top view of speaker 300. In one configuration, diaphragm 340 (corresponding to diaphragm 140 in FIG. 2*a*) spans the top of speaker 300 and is connected to speaker walls 370 and 370' with a connector 353 (corresponding to connector 153 in FIG. 2*a*). In another configuration, a top diaphragm 340 and a bottom diaphragm (not shown, corresponding to diaphragm 140' in FIG. 2*b*) span the top and bottom, respectively, of speaker 300, and are connected to speaker walls 370 and 370' using a top connector 353 and a bottom connector (not shown, corresponding to connector 153' in FIG. 2*b*). In either configuration, during operation, voice coil plate 350 will vibrate upward and downward, causing the diaphragm(s) to vibrate and emit sound.

Figure 4A:
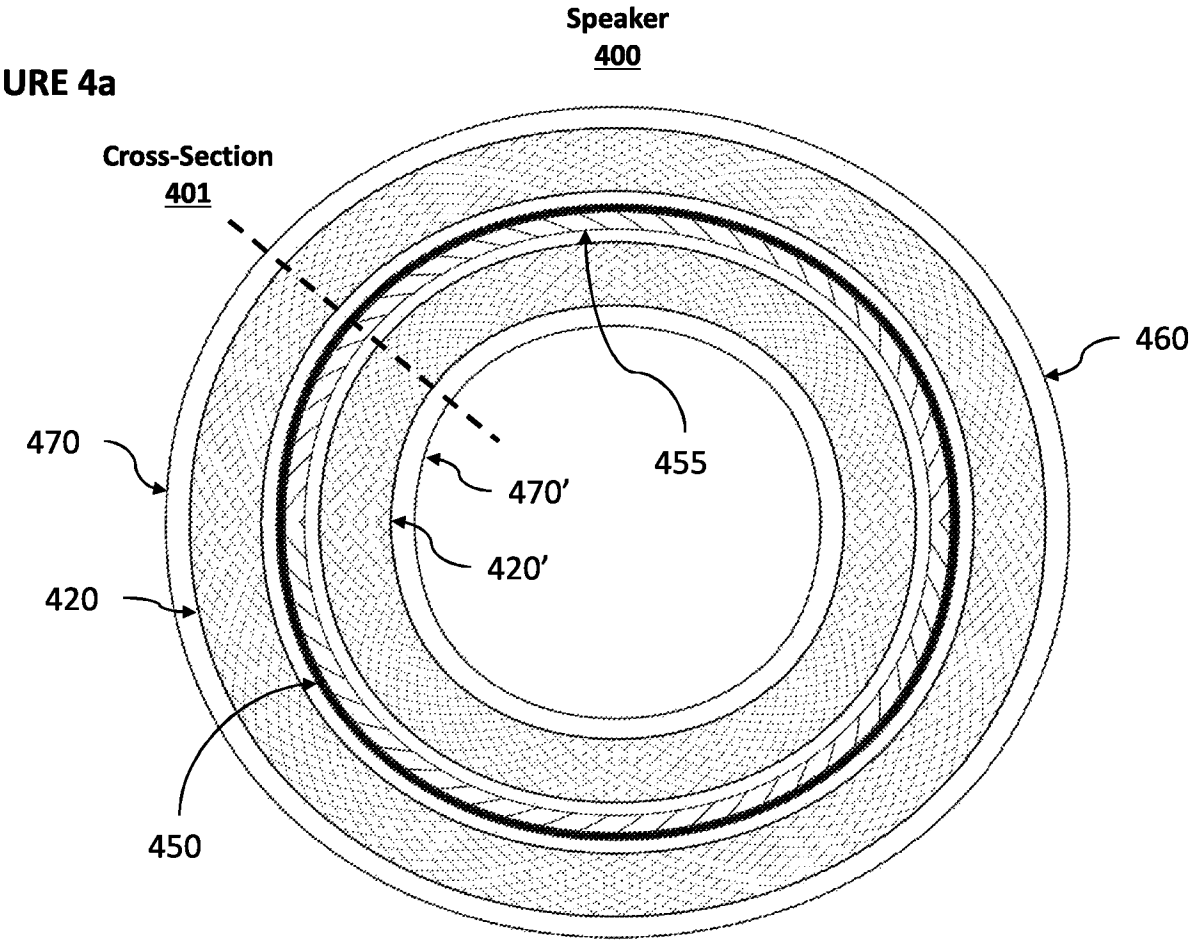
FIG. 4*a* depicts a cross-section of an embodiment of a speaker with a curved shape in the form of a pipe-ring.

FIG. 4*a* depicts a cross-section top view of speaker 400, which has the shape of a circle, and can be described as a pipe-ring speaker. Speaker 400 can be built according to cross-section 201 shown in FIG. 2*a*, or according to cross-section 205 shown in FIG. 2*b*. An exemplary cross-section 401 is shown, which corresponds to cross-section 201 in FIG. 2*a*, or to cross-section 205 in FIG. 2*b*, depending on if the design includes diaphragm 140' or damper 180, as appropriate.

FIG. 4*a* further shows speaker frame 460 which comprises speaker walls 470 and 470' (corresponding to speaker walls 170 and 170' in FIG. 2*a* and FIG. 2*b*), top magnetic yokes 420 and 420' (corresponding to top magnetic yokes 120 and 120' in FIG. 2*a* and FIG. 2*b*), voice coil plate 450

(corresponding to voice coil plate 150 in FIG. 2*a* and FIG. 2*b*), and coil 455 (corresponding to coil 155 in FIG. 2*a* and FIG. 2*b*).

Figure 4B:
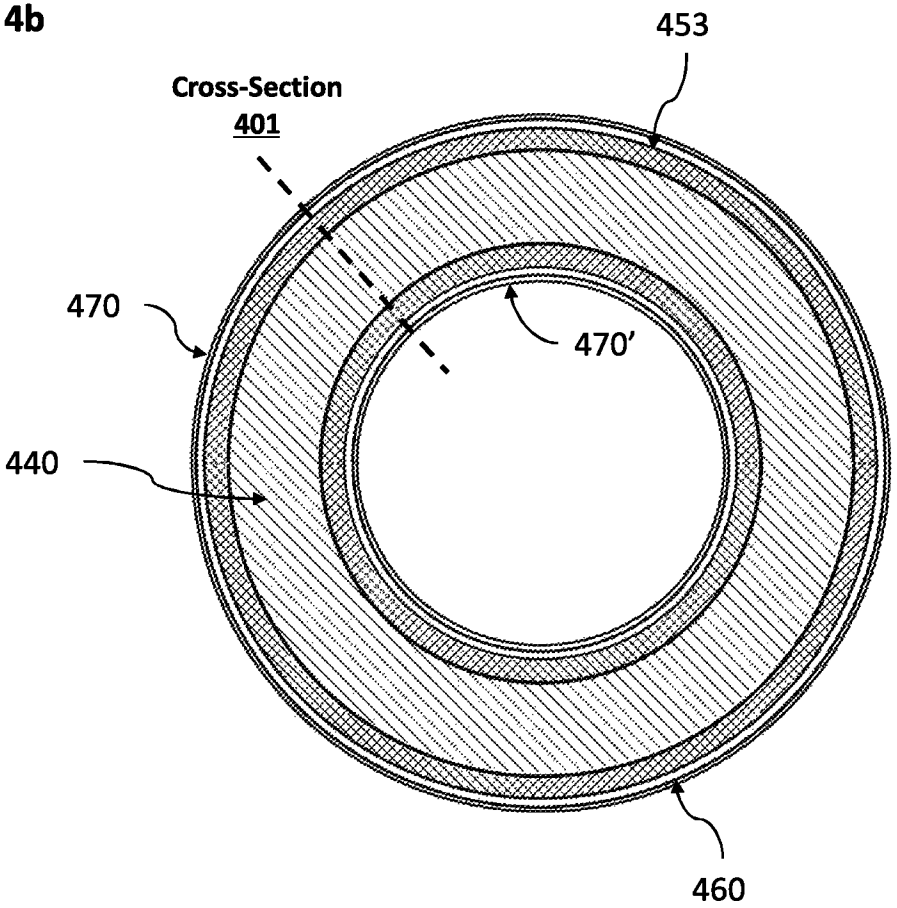
FIG. 4*b* depicts the top view of the embodiment of the speaker of FIG. 4*a*.

FIG. 4*b* shows a top view of speaker 400. In one configuration, diaphragm 440 (corresponding to diaphragm 140 in FIG. 2*a*) spans the top of speaker 400 and is connected to speaker walls 470 and 470' with a connector 453 (corresponding to connector 153 in FIG. 2*a*). In another configuration, a top diaphragm 440 and a bottom diaphragm (not shown, corresponding to diaphragm 140' in FIG. 2*b*) span the top and bottom, respectively, of speaker 400, and are connected to speaker walls 470 and 470' using a top connector 453 and a bottom connector (not shown, corresponding to connector 153' in FIG. 2*b*). In either configuration, during operation, voice coil plate 450 will vibrate upward and downward, causing the diaphragm(s) to vibrate and emit sound.

Optionally, speaker 400 can form part of a steering wheel in a vehicle. Speaker 400 can emit sound in two directions if two diaphragms (corresponding to diaphragms 140 and 140' in FIG. 2*b*) are used, or in one direction if only one diaphragm (corresponding to diaphragm 140 in FIG. 2*a*), is used. Moreover, frame 460 of speaker 400 can provide for an enclosure, so that the steering wheel is provided to include an appropriate defined acoustic space inside. This space, which is defined by the boundaries of the speaker frame, may be airtight, or instead include one or more ports, one or more passive radiators, or may provide for any other suitable acoustic enclosure design.

Figure 5A:
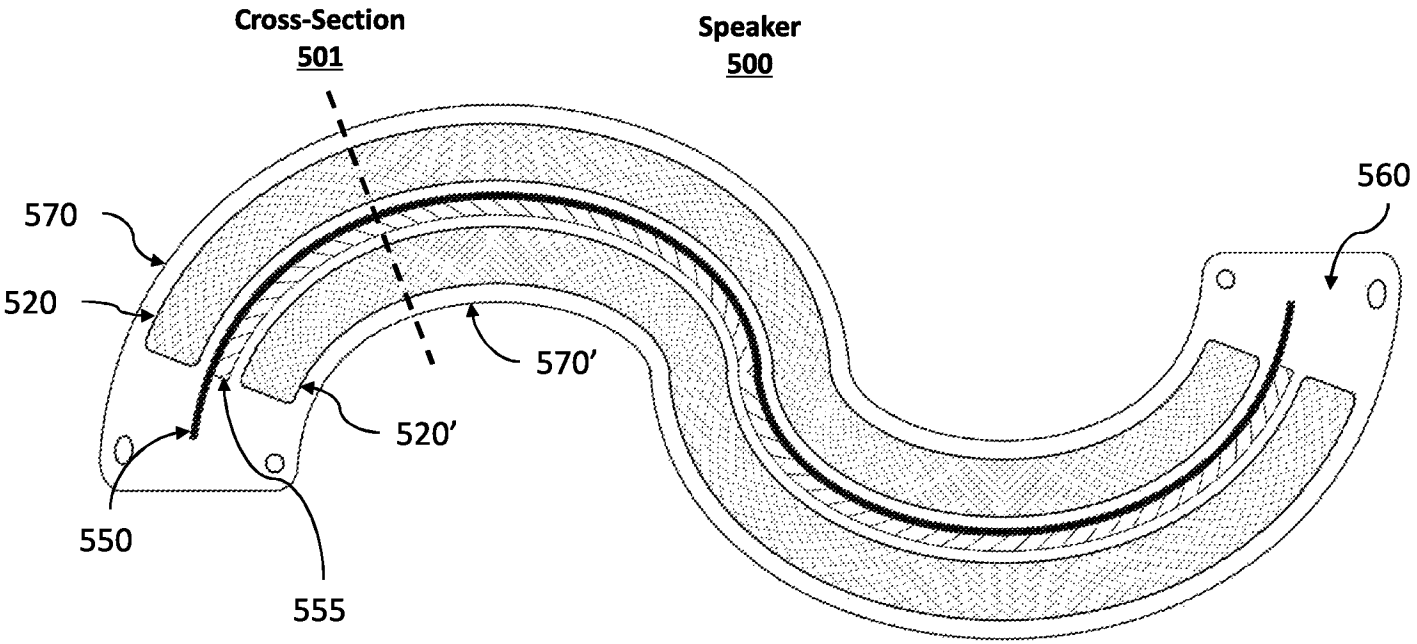
FIG. 5*a* depicts another cross-section of an embodiment of a speaker with a curved shape.

FIG. 5*a* depicts a cross-section top view of speaker 500, which has a curved shape. In particular, FIG. 5 shows the implementation of a speaker shaped like the letter "s". Speaker 500 can be built according to cross-section 201 shown in FIG. 2*a*, or according to cross-section 205 shown in FIG. 2*b*. An exemplary cross-section 501 is shown, which corresponds to cross-section 201 in FIG. 2*a*, or to cross-section 205 in FIG. 2*b*, depending on if the design includes diaphragm 140' or damper 180, as appropriate.

FIG. 5*a* further shows speaker frame 560 which comprises speaker walls 570 and 570' (corresponding to speaker walls 170 and 170' in FIG. 2*a* and FIG. 2*b*), top magnetic yokes 520 and 520' (corresponding to top magnetic yokes 120 and 120' in FIG. 2*a* and FIG. 2*b*), voice coil plate 550 (corresponding to voice coil plate 150 in FIG. 2*a* and FIG. 2*b*), and coil 555 (corresponding to coil 155 in FIG. 2*a* and FIG. 2*b*).

Figure 5B:
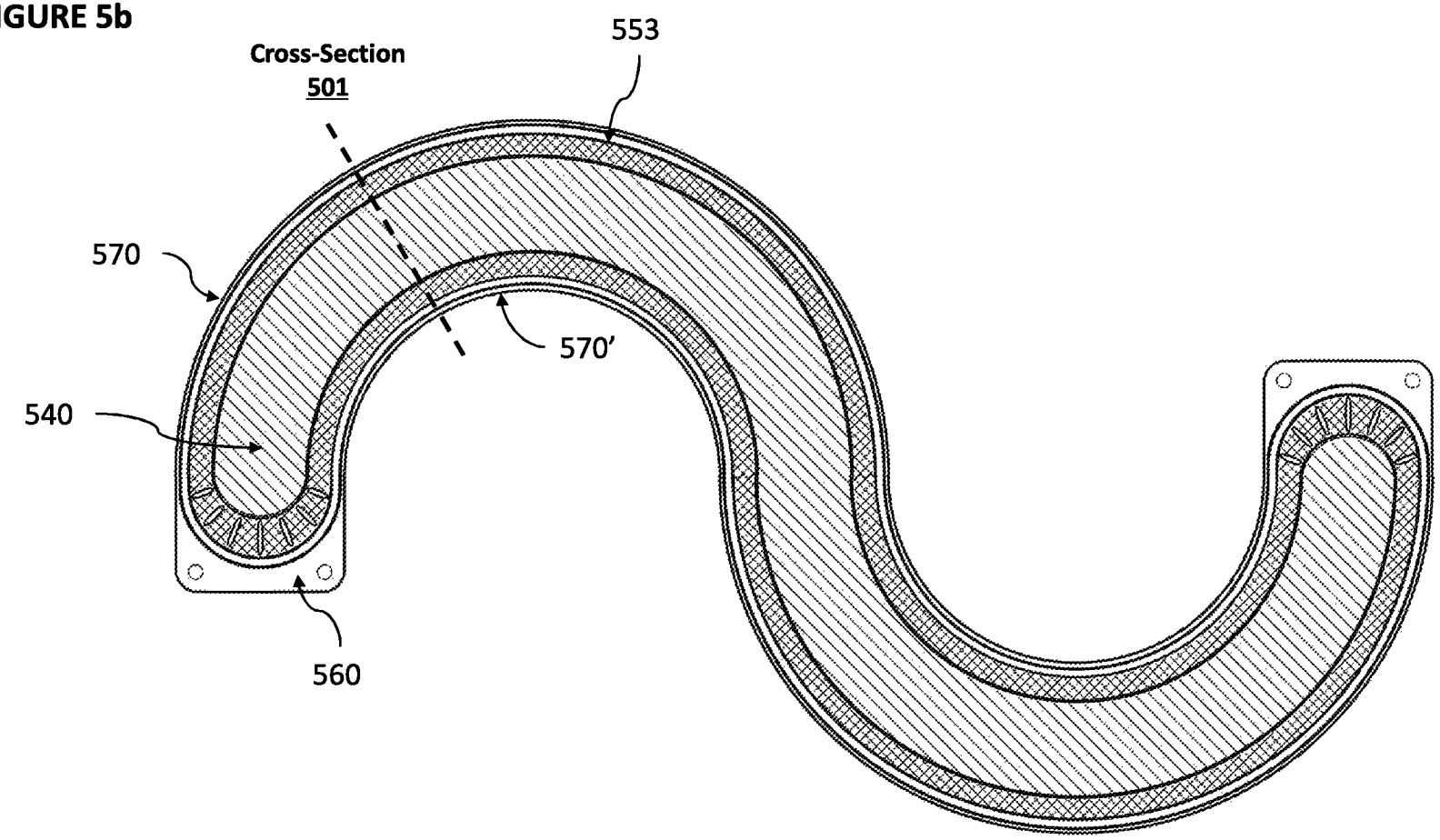
FIG. 5*b* depicts the top view of the embodiment of the speaker of FIG. 5*a*.

FIG. 5*b* shows a top view of speaker 500. In one configuration, diaphragm 540 (corresponding to diaphragm 140 in FIG. 2*a*) spans the top of speaker 500 and is connected to speaker walls 570 and 570' with a connector 553 (corresponding to connector 153 in FIG. 2*a*). In another configuration, a top diaphragm 540 and a bottom diaphragm (not shown, corresponding to diaphragm 140' in FIG. 2*b*) span the top and bottom, respectively, of speaker 500, and are connected to speaker walls 570 and 570' using a top connector 553 and a bottom connector (not shown, corresponding to connector 153' in FIG. 2*b*). In either configuration, during operation, voice coil plate 550 will vibrate upward and downward, causing the diaphragm(s) to vibrate and emit sound.

One of ordinary skill in the art will appreciate that speakers comprising any number of possible curved designs can be built using the concepts described above for FIGS. 2-5. Moreover, one of ordinary skill in the art will appreciate that the frame of the speaker can provide for an enclosure with an appropriate defined acoustic space inside. This space, which is defined by the boundaries of the speaker frame, may be airtight, include one or more ports, one or more passive radiators, or may provide for any other suitable acoustic enclosure design.

Figure 6A:
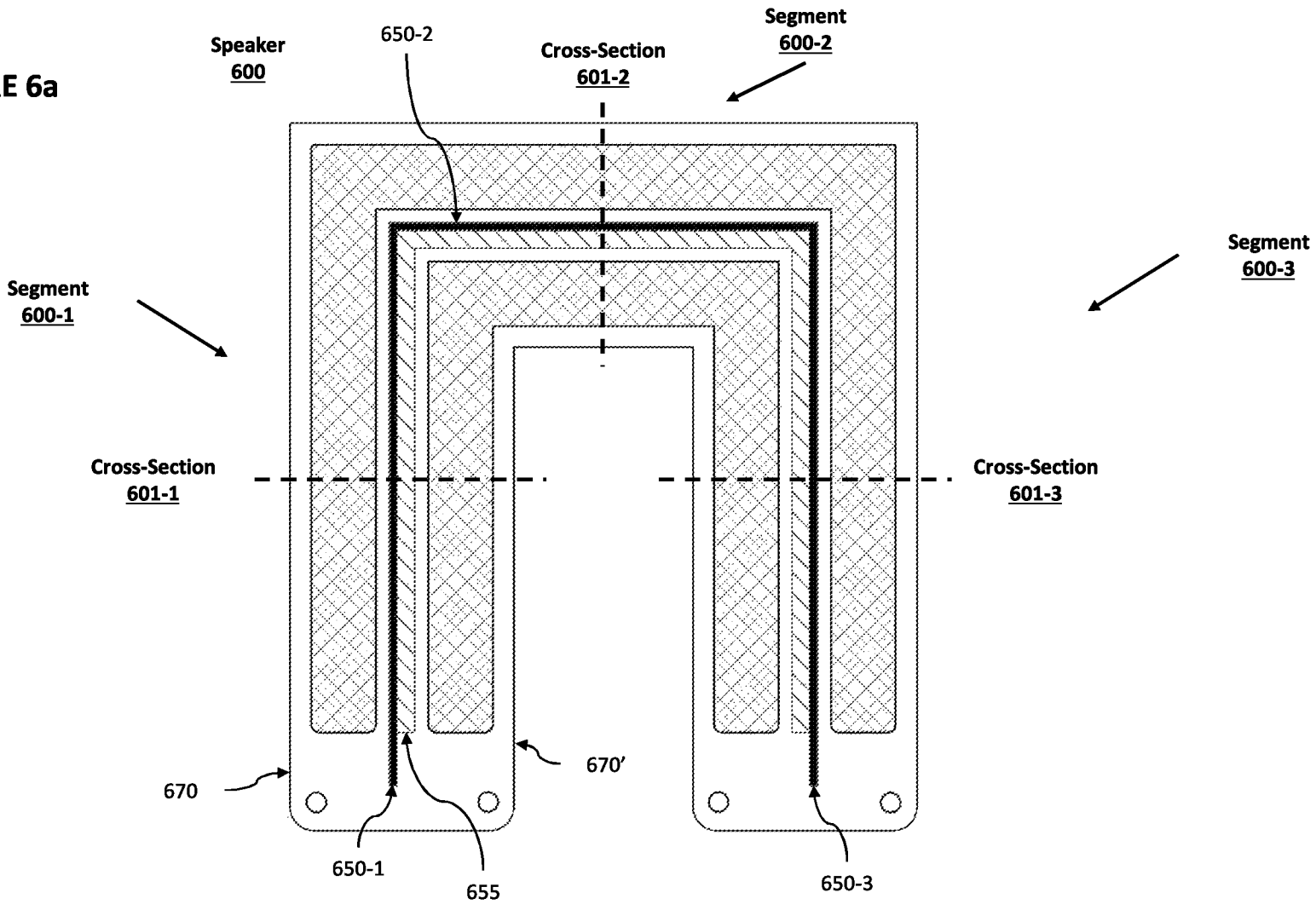
FIG. 6*a* depicts a cross-section top view an embodiment of a speaker with an angular shape.

FIG. 6*a* depicts a cross-section top view speaker 600, which comprises three straight segments 600-1, 600-2, and 600-3, arranged at an angle to one another. In this example, segment 600-1 and 600-2 are attached to form an approximately 90 degree angle, and segments 600-2 and 600-3 are attached to form an approximately 90 degree angle. It is to be understood that any other angle can be used instead of 90 degrees. Speaker 600 can be built according to cross-section 201 shown in FIG. 2*a*, or according to cross-section 205 shown in FIG. 2*b*. Exemplary cross-sections 601-1, 601-2, and 601-3 are shown, each of which corresponds to cross-section 201 in FIG. 2*a*, or to cross-section 205 in FIG. 2*b*, depending on if the section includes diaphragm 140' or damper 180, as appropriate.

Figure 6B:
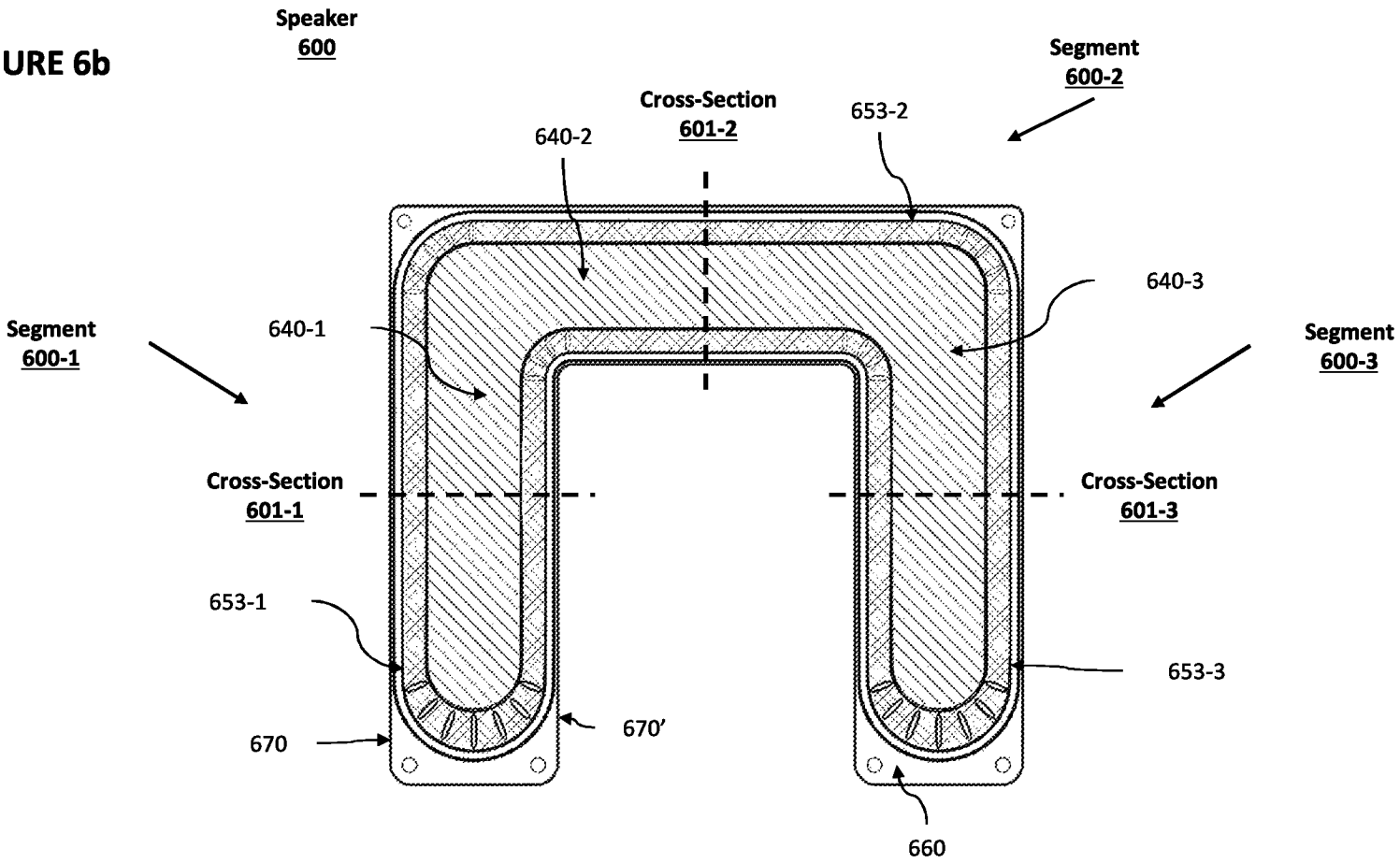
FIG. 6*b* depicts the top view of the embodiment of the speaker of FIG. 6*a*.

FIG. 6*b* depicts a top view of speaker 600 and shows diaphragms 640-1, 640-2, and 640-3 connected to frame 660 (which comprises wall 670 and wall 670') by connectors 653-1, 653-2, and 653-3, respectively, corresponding to connector 153 in FIG. 2*a* and FIG. 2*b*. Diaphragm segments 640-1, 640-2, and 640-3 may comprise the same diaphragm, as shown in FIG. 6*b*. Optionally, diaphragm segments 640-1, 640-2, and 640-3 may comprise more than one diaphragm as needed (not shown).

During the operation of speaker 600, each of the segments 600-1, 600-2, and 600-3 are driven by a voice coil plate segment 650-1, 650-2, and 650-3, respectively, corresponding to voice coil plate 150 in FIG. 2*a* and FIG. 2*b*. Voice coil plate segments 650-1, 650-2, 650-3 may share a single coil 655 as shown in FIG. 6*a* wound on one or both sides of each voice coil plate segment; or optionally, each segment 650-1, 650-2, 650-3 may have a dedicated coil wound on one or both sides of the voice coil plate segment (not shown) and/or within the voice coil plate segment. Each voice coil plate will vibrate upward and downward, causing diaphragm segments 640-1, 640-2, and 640-3 to vibrate and emit sound. The coils can be driven by the same electrical signal or by different electrical signals provided by signal source 250 (not shown) over the necessary number of wires.

Figure 7A:
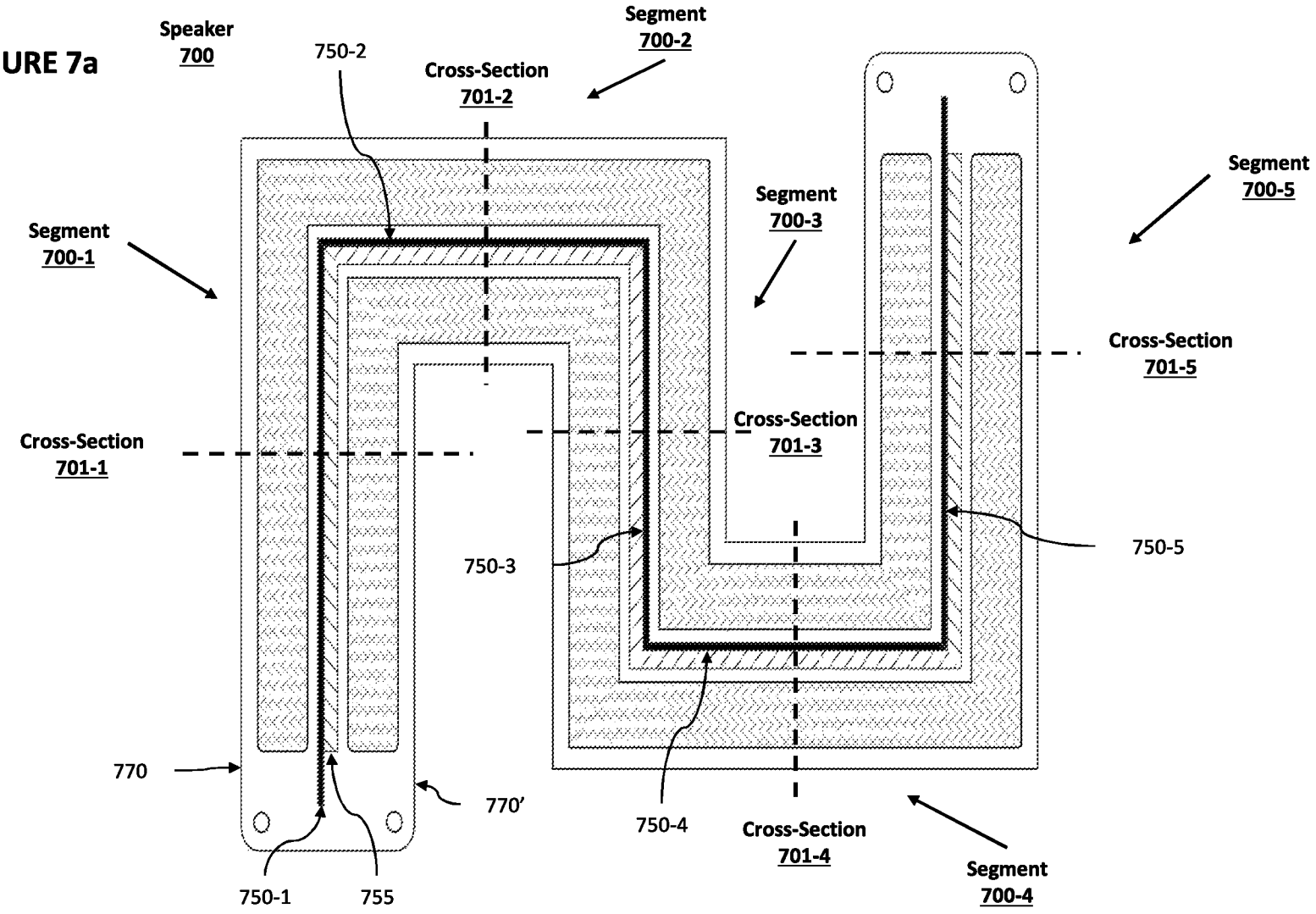
FIG. 7*a* depicts another cross-section top view embodiment of a speaker with an angular shape.

FIG. 7*a* depicts a cross-section top view of speaker 700, which comprises five straight segments 700-1, 700-2, 700-3, 700-4, and 700-5, arranged at an angle to one another. In this example, segments 700-1 and 700-2 are attached to form an approximately 90 degree angle, segments 700-2 and 700-3 are attached to form an approximately 90 degree angle, segments 700-3 and 700-4 are attached to form an approximately 90 degree angle, and segments 700-4 and 700-5 are attached to form an approximately 90 degree angle. It is to be understood that any other angle can be used instead of 90 degrees. Speaker 700 can be built according to cross-section 201 shown in FIG. 2*a*, or according to cross-section 205 shown in FIG. 2*b*. Exemplary cross-sections 701-1, 701-2, 701-3, 701-4, and 701-5 are shown, each of which corresponds to cross-section 201 in FIG. 2*a*, or to cross-section 205 in FIG. 2*b*, depending on if the section includes diaphragm 140' or damper 180, as appropriate.

Figure 7B:
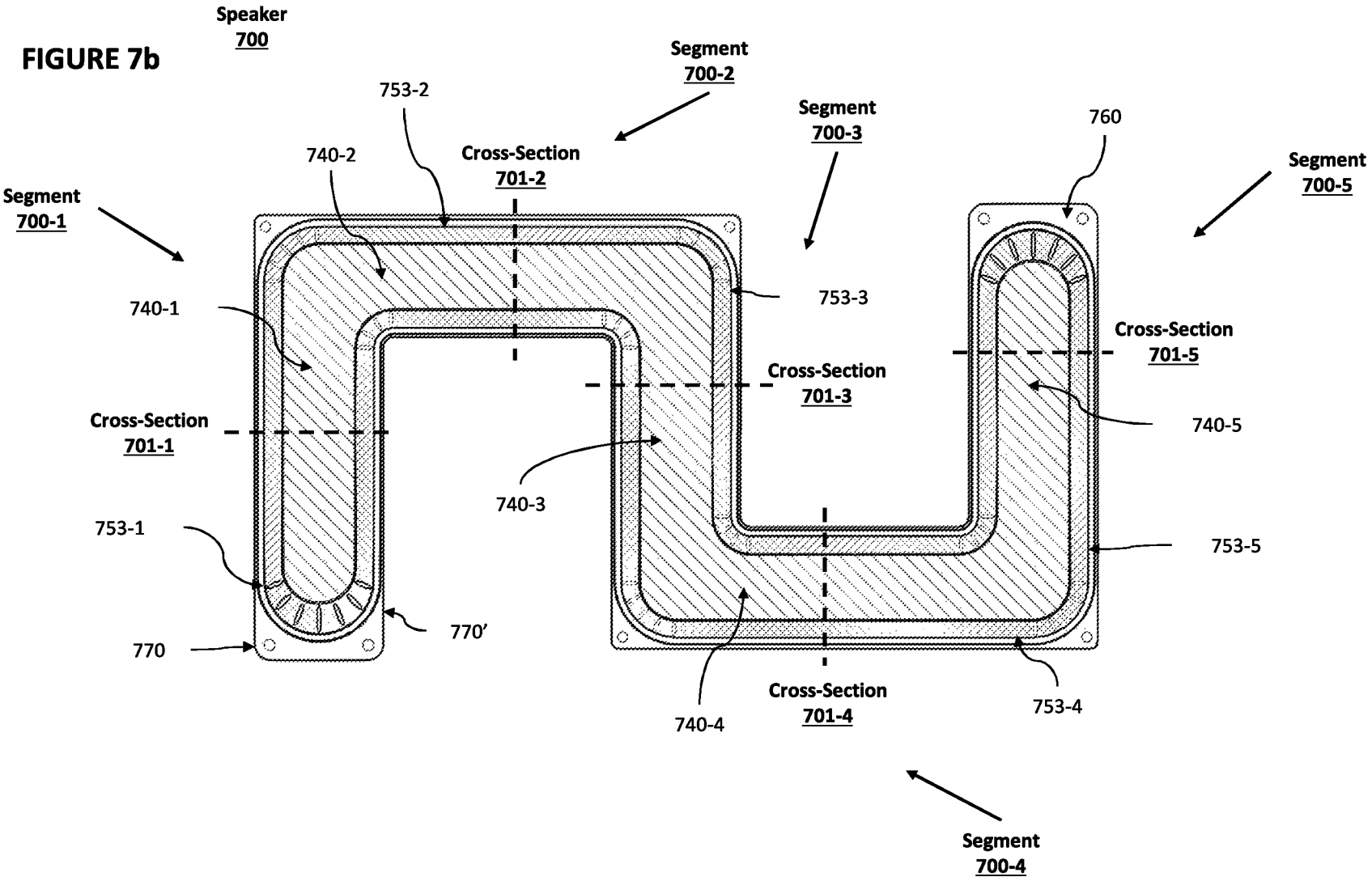
FIG. 7*b* depicts the top view of the embodiment of the speaker of FIG. 7*a*.

FIG. 7*b* depicts a top view of speaker 700 and shows diaphragms 740-1, 740-2, 740-3, 740-4, and 740-5, each connected to speaker frame 760 (which comprises wall 770 and wall 770') by connectors 753-1, 753-2, 753-3, 753-4, and 753-5, respectively, corresponding to connector 153 in FIG. 2*a* and FIG. 2*b*. Diaphragm segments 740-1, 740-2, 740-3, 740-4, and 740-5 may comprise the same diaphragm, as shown in FIG. 7*b*. Optionally, diaphragm segments 740-1, 740-2, 740-3, 740-4, and 740-5 may comprise more than one diaphragm as needed (not shown).

During the operation of speaker 700, each of the segments 700-1, 700-2, 700-3, 700-4, and 700-5 are driven by a voice coil plate segment 750-1, 750-2, 750-3, 750-4, and 750-5, respectively, corresponding to voice coil plate 150 in FIG. 2*a* and FIG. 2*b*. Voice coil plate segments 750-1, 750-2, 750-3, 750-4, 750-5 may share a single coil 755 as shown in FIG. 7*a* wound on one or both sides of each voice coil plate segment; or optionally, each segment 750-1, 750-2, 750-3, 750-4, 750-5 may have a dedicated coil wound within and/or on one or both sides of the voice coil plate segment (not shown). During operation, each voice coil plate will vibrate upward and downward, causing diaphragms 740-1, 740-2, 740-3, 740-4, and 740-5 to vibrate and emit sound. The coils can be driven by the same electrical signal or by different electrical signals provided by signal source 250 (not shown) over the necessary number of wires.

One of ordinary skill in the art will appreciate that speakers comprising any number of possible segments arranged at any number of possible angles can be built using the concepts described above for FIGS. 2, 6, and 7. Optionally, in each of these embodiments, the parts of each segment, such as the frame, diaphragm(s), magnets, magnetic yokes, voice coil plates, coils, and/or dampers may be combined between adjacent segments to build substantially the same speaker with fewer parts as specified in the speaker design. Also, optionally, more than one diaphragm may be attached to any given side of a voice coil plate as specified in the speaker design. Moreover, one of ordinary skill in the art will appreciate that the frame of the speaker can provide for an enclosure with an appropriate defined acoustic space inside. The space may be airtight, include one or more ports, one or more passive radiators, or may provide for any other suitable acoustic enclosure design.

Figure 8A:
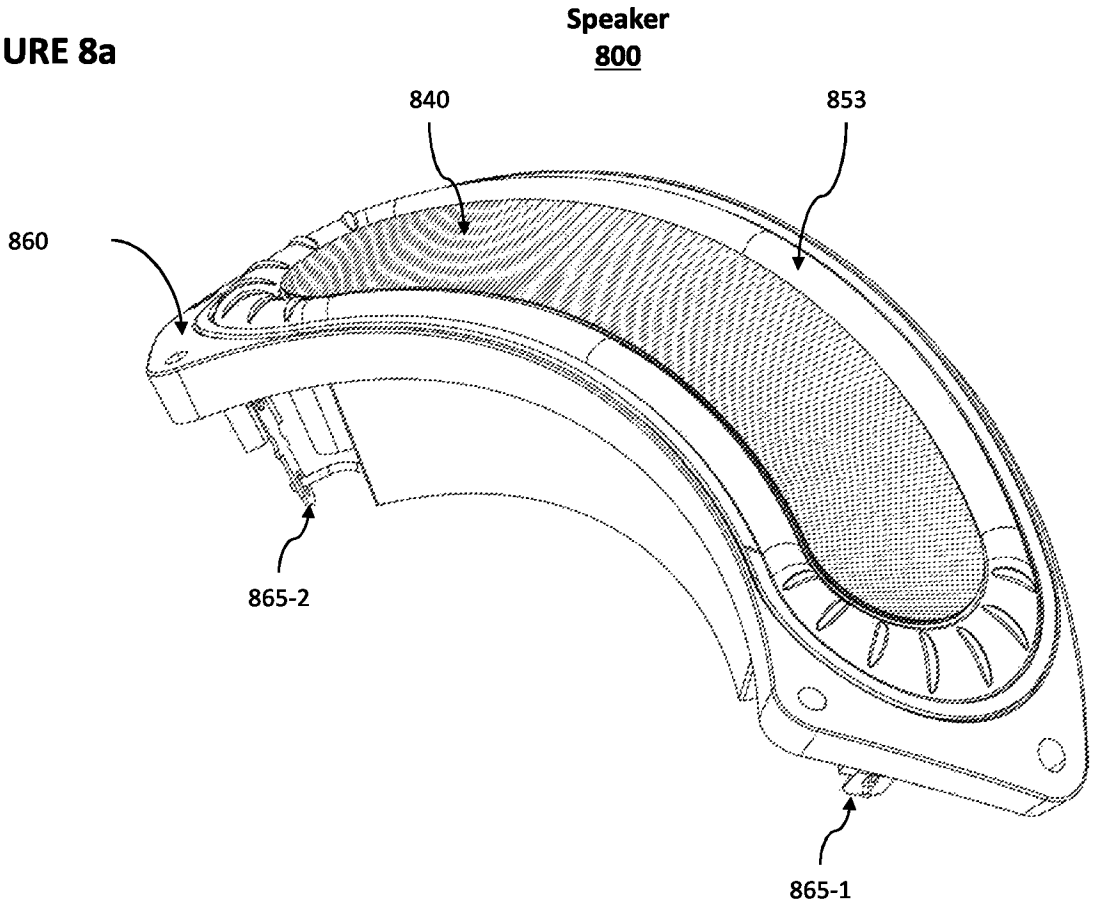
FIG. 8*a* depicts a three-dimensional perspective view of an embodiment of a speaker with a shape that is curved in three dimensions.

FIG. 8*a* depicts speaker 800 from a three-dimensional perspective view, which is curved in three dimensions. This is evident by diaphragm 840, frame 860, and connector 853 which are curved in three dimensions. The cross sections of this speaker correspond to that of cross section 201, and it is also understood that this speaker could be designed with another diaphragm on the bottom side of the speaker, which would make its cross sections correspond to that of cross section 205. The magnets and voice coil plate (not shown) optionally are curved in three-dimensions as well. Electrical terminals, for example terminal 865-1 and terminal 865-2 as shown in FIG. 8*a* may be added to the frame of the speaker as needed.

Figure 8B:
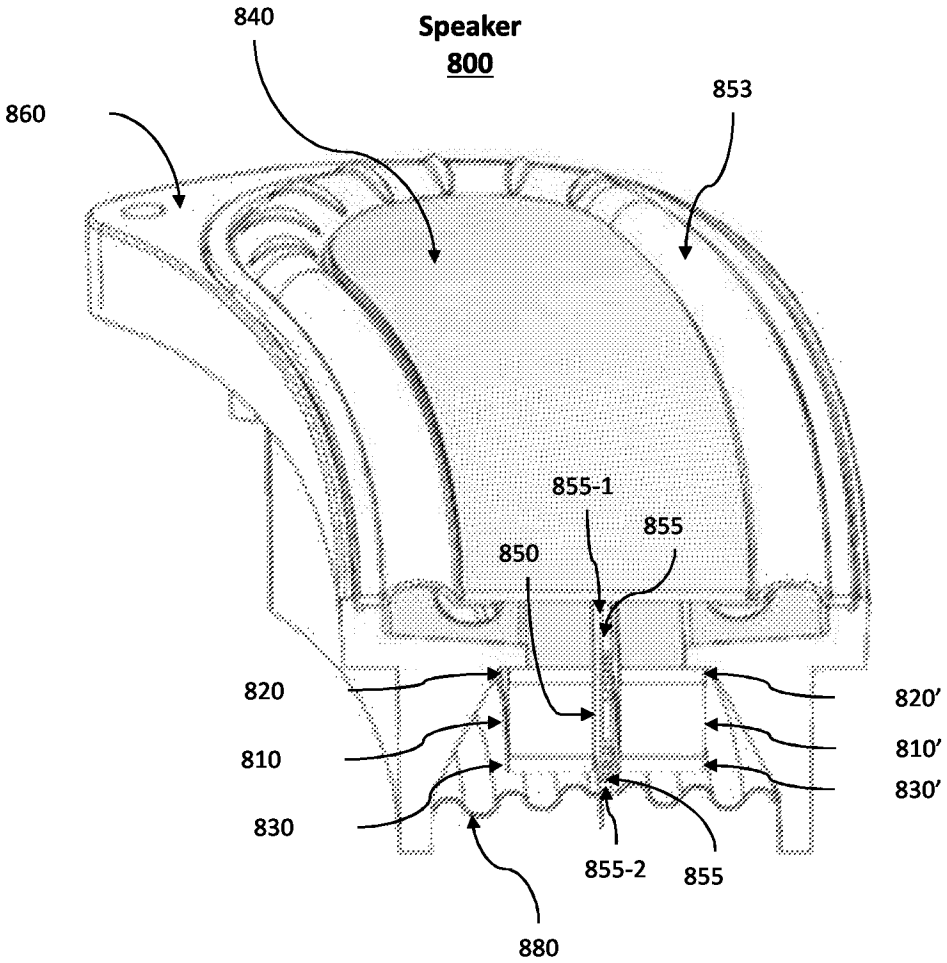
FIG. 8*b* depicts a cross-section view of the speaker of FIG. 8*a*.

FIG. 8*b* depicts a three-dimensional cross section perspective view of speaker 800, which is curved in three dimensions. This particular cross section corresponds to cross section 201 of FIG. 2*a*, but in another embodiment it would be possible to design speaker 800 to correspond to cross section 205 of FIG. 2*b*. Speaker 800 further comprises magnets 810 and 810', top magnetic yokes 820 and 820', bottom magnetic yokes 830 and 830', voice coil plate 850, voice coil 855, and damper 880. Voice coil 855 comprises a top segment 855-1 and a bottom segment 855-2. As in previously discussed embodiments, the voice coil 855 of speaker 800 may also be wound on one or both sides of the voice coil plate 850.

One of ordinary skill in the art will appreciate that speakers comprising any number of possible segments arranged at any number of possible angles can be built using the concepts described above for FIGS. 2-8, especially those comprising a three-dimensional arrangement. Moreover, one of ordinary skill in the art will appreciate that the frame of the speaker can provide for an enclosure with an appropriate defined acoustic space inside. The space may be airtight, include one or more ports, one or more passive radiators, or may provide for any other suitable acoustic enclosure design.

In all embodiments of the speaker mentioned in this patent, each voice coil may be comprised of any electrically-conductive material, including but not limited to, any variant of copper wire, printed circuit board, flexible printed circuit board, or other conductive metal or alloy. In general, the voice coil may be formed within, or on one or both sides of a fixing member, with any specified number of layers and any specified number of turns in each layer.

Figure 9:
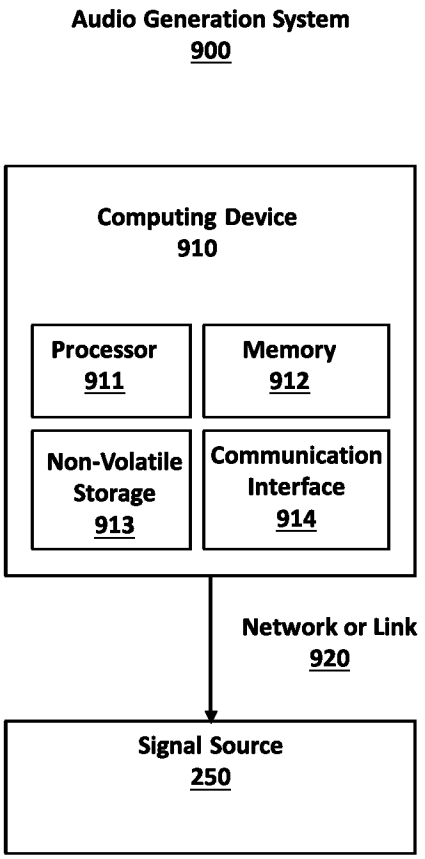
FIG. 9 depicts a driver receiving an audio signal from a computing device over a wired or wireless connection.

FIG. 9 depicts audio generation system 900 which generates the audio signal that signal source 250 eventually provides to a speaker such as speakers 200, 300, 400, 500, 600, 700, and 800. Audio generation system 900 comprises computing device 910 and signal source 250. Computing device 910 comprises processor 911, memory 912, non-volatile storage 913, and communication interface 914. Processor 911 optionally comprises a microprocessor with one or more processing cores. Memory 912 optionally comprises DRAM or SRAM volatile memory and can store software instructions that are executed by processor 911, as well as audio data. Non-volatile storage 913 optionally comprises a hard disk drive or flash memory array. Communication interface 914 comprises one or more of a wired transceiver (such as a network interface compliant with a wired protocol such as that known by the trademark ETHERNET) and a wireless transceiver (such as an interface compliant with a wireless protocol such as those known by the trademarks BLUETOOTH, WIFI, 3G, 4G, 5G, and LTE).

Computing device 910, through communication interface 914, provides an audio electrical signal over network or link 920 to signal source 250. Network or link 920 can be a wired connection or a wireless connection (such as the wireless protocol known by the trademarks BLUETOOTH, WIFI, 3G, 4G, 5G, and LTE). Computing device 910 determines the appropriate range of signal frequency and chooses the appropriate diaphragm for output.

It can be appreciated that the flexible designs enabled by the invention will allow speakers to be built in a shape that is specifically suited for the structure in which the speaker is placed. For example, a long and thin speaker might be fashioned for a speaker placed at the edge of a laptop, tablet, or phone, or a plurality of segments can be connected at approximately 90 degrees and be placed along adjacent edges of a laptop, tablet, or phone. As another example, a long and curved speaker might be fashioned to be placed in a vertical column of a car. As discussed above with reference to FIG. 4, a pipe ring speaker such as speaker 400 can be embedded into a steering wheel of a vehicle. As another example, a speaker can be integrated into other items, such as a piece of furniture such as a table, lamp, chair, or nightstand.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, and procedures which, although not explicitly shown or described herein, embody the principles of the disclosure and can be thus within the spirit and scope of the disclosure. Various different exemplary embodiments can be used together with one another, as well as interchangeably therewith, as should be understood by those having ordinary skill in the art. In addition, certain terms used in the present disclosure, including the specification, drawings and claims thereof, can be used synonymously in certain instances, including, but not limited to, for example, data and information. It should be understood that, while these words, and/or other words that can be synonymous to one another, can be used synonymously herein, that there can be instances when such words can be intended to not be used synonymously. Further, to the extent that the prior art knowledge has not been explicitly incorporated by reference herein above, it is explicitly incorporated herein in its entirety. All publications referenced are incorporated herein by reference in their entireties.

What is claimed is:

1. A speaker comprising:

a first magnet comprising a north pole and a south pole and having a curved shape;

a second magnet comprising a north pole and a south pole and having a curved shape such that the second magnet is parallel to the first magnet, the second magnet located a predefined distance from the first magnet with the north pole of the second magnet facing the south pole of the first magnet and the south pole of the second magnet facing the north pole of the first magnet;

a voice coil plate located between the first magnet and the second magnet and having a curved shape, such that the voice coil plate is parallel to the first magnet and the second magnet, the voice coil plate comprising a coil for receiving an electrical signal formed within and/or on one or both sides of the voice coil plate; and a first diaphragm attached to a first end of the voice coil plate; and a second diaphragm attached to a second end of the voice coil plate;

wherein the voice coil plate vibrates the first diaphragm and the second diaphragm in response to force generated by the electrical signal in the coil and a magnetic field between the first magnet and the second magnet.

2. The speaker of claim 1, wherein the first diaphragm and the second diaphragm are of different sizes, such that the first diaphragm is capable of reproducing sound within a first frequency range and the second diaphragm is capable of reproducing sound within a second frequency range different than the first frequency range.

3. The speaker of claim 1, further comprising:

a first magnetic yoke attached to a first side of the first magnet;

a second magnetic yoke attached to a first side of the second magnet;

a third magnetic yoke attached to a second side of the first magnet; and a fourth magnetic yoke attached to a second side of the second magnet.

4. The speaker of claim 1, further comprising:

a speaker frame which may enclose the speaker.

5. The speaker of claim 1, wherein the first diaphragm has a curved shape in three dimensions.

6. A speaker comprising:

a first magnet comprising a north pole and a south pole and having a curved shape;

a second magnet comprising a north pole and a south pole and having a curved shape such that the second magnet is parallel to the first magnet, the second magnet located a predefined distance from the first magnet with the north pole of the second magnet facing the south pole of the first magnet and the south pole of the second magnet facing the north pole of the first magnet;

a voice coil plate located between the first magnet and the second magnet and having a curved shape, such that the voice coil plate is parallel to the first magnet and the second magnet, the voice coil plate comprising a coil for receiving an electrical signal formed within and/or on one or both sides of the voice coil plate; and a first diaphragm attached to a first end of the voice coil plate;

wherein the voice coil plate vibrates the first diaphragm in response to force generated by the electrical signal in the coil and a magnetic field between the first magnet and the second magnet; and wherein the voice coil plate comprises a printed circuit board which comprises an etched coil, wherein the etched coil is etched into a plurality of layers within the printed circuit board.

7. A speaker comprising:

a pipe ring speaker frame;

a first magnet arranged in a ring and located in the pipe ring speaker frame comprising a north pole and a south pole;

a second magnet arranged in a ring and located in the pipe ring speaker frame comprising a north pole and a south pole and parallel to the first magnet, the second magnet located a predefined distance from the first magnet with the north pole of the second magnet facing the south pole of the first magnet and the south pole of the second magnet facing the north pole of the first magnet;

a voice coil plate located in the pipe ring speaker frame between the first magnet and the second magnet, such that the voice coil plate is parallel to the first magnet and the second magnet, the voice coil plate comprising a coil for receiving an electrical signal formed within, and/or on one or both sides of the voice coil plate; and a first diaphragm attached to a first end of the voice coil plate;

wherein the voice coil plate vibrates the first diaphragm in response to force generated by the electrical signal in the coil and a magnetic field between the first bar magnet and the second bar magnet.

8. The speaker of claim 7, further comprising:

a second diaphragm attached to a second end of the voice coil plate;

wherein the voice coil plate vibrates the second diaphragm in response to force generated by the electrical signal in the coil and a magnetic field between the first magnet and the second magnet.

9. The speaker of claim 8, wherein the first diaphragm and the second diaphragm are of different sizes, such that the first diaphragm is capable of reproducing sound within a first frequency range and the second diaphragm is capable of reproducing sound within a second frequency range different than the first frequency range.

10. The speaker of claim 7, further comprising:

a first magnetic yoke attached to a first side of the first magnet;

a second magnetic yoke attached to a first side of the second magnet;

a third magnetic yoke attached to a second side of the first magnet; and a fourth magnetic yoke attached to a second side of the second magnet.

11. The speaker of claim 7 further comprising:

a speaker frame which may enclose the speaker.

12. The speaker of claim 7, wherein the voice coil plate comprises a printed circuit board which comprises an etched coil, wherein the etched coil is etched into a plurality of layers within the printed circuit board.

13. The speaker of claim 7, wherein the speaker is part of a steering wheel in a vehicle.

14. A speaker comprising:

a first speaker segment, comprising:

a first bar magnet comprising a north pole and a south pole;

a second bar magnet comprising a north pole and a south pole, the second bar magnet located a predefined distance from and parallel to the first bar magnet with the north pole of the second bar magnet facing the south pole of the first bar magnet and the south pole of the second bar magnet facing the north pole of the first bar magnet;

a first voice coil plate located between the first bar magnet and the second bar magnet, the first voice coil plate comprising a first coil for receiving an electrical signal formed within, and/or on one or both sides of the voice coil plate; and a first diaphragm attached to a first end of the voice coil plate;

wherein the first voice coil plate vibrates the first diaphragm in response to force generated by the electrical signal in the first coil and a magnetic field between the first bar magnet and the second bar magnet; and a second speaker segment, comprising:

a third bar magnet comprising a north pole and a south pole;

a fourth bar magnet comprising a north pole and a south pole, the fourth bar magnet located a predefined distance from and parallel to the third bar magnet with the north pole of the fourth bar magnet facing the south pole of the third bar magnet and the south pole of the fourth bar magnet facing the north pole of the third bar magnet;

a second plate located between the third bar magnet and the fourth bar magnet, the second voice coil plate comprising a second coil for receiving a second electrical signal formed within, or on one or both sides of the voice coil plate; and a second diaphragm attached to a first end of the second voice coil plate;

wherein the second voice coil plate vibrates the second diaphragm in response to force generated by the electrical signal in the second coil and a magnetic field between the third bar magnet and the fourth bar magnet;

wherein the first speaker segment is attached to the second speaker segment at a specified angle.

15. The speaker of claim 14, further comprising:

a third diaphragm attached to a second end of the first voice coil plate; and a fourth diaphragm attached to a second end of the second voice coil plate;

wherein the first voice coil plate vibrates the third diaphragm in response to force generated by the electrical signal in the first coil and a magnetic field between the first magnet and the second magnet, and the second voice coil plate vibrates the fourth diaphragm in response to force generated by the electrical signal in the second coil and a magnetic field between the third magnet and the fourth magnet.

16. The speaker of claim 14, wherein the first diaphragm and the second diaphragm are of different sizes, such that the first diaphragm is capable of reproducing sound within a first frequency range and the second diaphragm is capable of reproducing sound within a second frequency range different than the first frequency range.

17. The speaker of claim 14, further comprising:

a first magnetic yoke attached to a first side of the first magnet;

a second magnetic yoke attached to a first side of the second magnet;

a third magnetic yoke attached to a second side of the first magnet;

a fourth magnetic yoke attached to a second side of the second magnet;

a fifth magnetic yoke attached to a first side of the third magnet;

a sixth magnetic yoke attached to a first side of the fourth magnet;

a seventh magnetic yoke attached to a second side of the third magnet; and an eighth magnetic yoke attached to a second side of the fourth magnet.

18. The speaker of claim 14 further comprising:

a speaker frame which may enclose the speaker.

19. The speaker of claim 14, wherein the voice coil plate comprises a printed circuit board which comprises an etched coil, wherein the etched coil is etched into a plurality of layers within the printed circuit board.

* * * * *